US008550305B2

(12) United States Patent
Abi Aad

(10) Patent No.: US 8,550,305 B2
(45) Date of Patent: Oct. 8, 2013

(54) WATER COOLER

(75) Inventor: Marwan Abi Aad, Falls Church, VA (US)

(73) Assignee: Nurakwa, LLC, McLean, VA (US)

( * ) Notice: Subject to any disclaimer, the term of this patent is extended or adjusted under 35 U.S.C. 154(b) by 829 days.

(21) Appl. No.: 12/503,838

(22) Filed: Jul. 16, 2009

(65) Prior Publication Data

US 2011/0011885 A1 Jan. 20, 2011

(51) Int. Cl.
*B67D 7/80* (2010.01)

(52) U.S. Cl.
USPC ..... 222/146.6; 62/457.9

(58) Field of Classification Search
USPC ..... 222/146.6, 146.1; 62/441, 498, 407, 62/390, 319, 317, 318, 457.3–457.9, 62/440–443; 220/592.01, 592.16–592.19, 220/731
See application file for complete search history.

(56) References Cited

U.S. PATENT DOCUMENTS

| | | | | | |
|---|---|---|---|---|---|
| 99,170 | A * | 1/1870 | Dows | 220/592.18 |
| 648,904 | A * | 5/1900 | Hart | 62/319 |
| 912,281 | A * | 2/1909 | Brunner et al. | 222/131 |
| 1,551,572 | A * | 9/1925 | Kneuper | 62/319 |
| 1,572,242 | A * | 2/1926 | McLaughlin | 62/392 |
| 1,607,347 | A * | 11/1926 | Hemman | 62/392 |
| 1,625,803 | A * | 4/1927 | Haas et al. | 62/400 |
| 2,088,376 | A * | 7/1937 | Kaskey | 366/256 |
| 4,878,363 | A * | 11/1989 | Wells et al. | 62/400 |
| 5,246,141 | A * | 9/1993 | Burrows | 222/146.1 |
| 5,289,951 | A * | 3/1994 | Burrows | 222/146.6 |
| 5,390,826 | A * | 2/1995 | Burrows | 222/146.6 |
| 6,648,174 | B2 * | 11/2003 | Greene | 222/66 |
| 2005/0160759 | A1 * | 7/2005 | Chaney et al. | 62/389 |
| 2006/0060607 | A1 * | 3/2006 | Chang | 222/146.6 |

* cited by examiner

*Primary Examiner* — Lien Ngo
(74) *Attorney, Agent, or Firm* — Krishna Kalidindi

(57) ABSTRACT

A water cooler includes a reservoir with an inlet and an outlet. The water cooler is separated into two compartments by a wall containing at least one opening allowing fluid communication between the compartments. A cooling element extends from a bottom surface of the reservoir through the bottom compartment and through the wall and into the top compartment. Water enters the top compartment through an inlet where it is cooled before flowing into the bottom compartment through any openings in the wall. Water exits the bottom compartment through an outlet.

10 Claims, 2 Drawing Sheets

WATER COOLER

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO COMPACT DISC APPENDIX

Not applicable.

BACKGROUND OF INVENTION

1. Field of the Invention

The present invention relates to a water cooler and more particularly to a water cooler that supplies cooled water directly to a commercial or residential plumbing system.

2. Background of the Related Art

In climates in which ambient temperatures reach high levels, the temperature of a water source can be affected. In such situations, the temperature of a water source can reach levels that make that water unusable for many standard applications. By way of example, warm water is unpleasant for drinking purposes unless it is first chilled. The preparation of certain foods requires the use of cool water. Similarly, general hygienic practices, such as showering, become uncomfortable or unbearable in warm conditions when there is no source of cool water. Many types of clothes and linens require laundering in cold water only and will be damaged if laundered in warm water. Furthermore, the relief from hot temperatures offered by a cool shower or cool drink is not an option when only warm and hot water are available.

At the present time, water coolers used to provide cool drinking water are well known. In these water coolers, water is supplied to a reservoir from removable water bottles or an installed water line. The water in the reservoir is cooled and stored until dispensed from a valve connected to the reservoir. These common water coolers suffer from several disadvantages.

Current water coolers are used to supply cool water for drinking purposes. They provide no practical means for utilizing the cooled water for other purposes that benefit from a cool water supply, such as food preparation, bathing or laundering.

Cooled water is typically dispensed at the valve connected directly to the water cooler. These water coolers are not intended to supply cool water for use throughout a plumbing system. There is no method by which cooled water from the reservoirs can be made available to the remainder of the plumbing system. A standard plumbing system will have numerous outputs, none of which will have access to the cool water produced by a typical water cooler.

Current water coolers supply cool water in limited volumes. The volumes of cool water made available by these systems are restricted by several factors. The size of the replaceable water bottle supplying the water to the water cooler is one such limitation. In water coolers supplied by a water line, the volume of cool water provided is restricted by the maximum output flow of the dispenser installed in the water cooler and by the rate at which these apparatuses cool water that is constantly flowing through the reservoir.

Common water coolers chill water within a single undivided reservoir. Warm water entering the reservoir flows unrestricted into the reservoir. As a result, there is direct thermal mixing of the warm water entering the reservoir with the cooled water already in the reservoir and the resulting output water is warmer.

Water chillers are also well known. They are capable of producing large volumes of cooled water. These chillers are commonly used to cool circulated air in commercial air conditioning systems and to cool machinery in industrial settings. The cooled water of a typical water chiller flows in a closed-loop system. As such, the cooled water produced in such a system is not available for any uses outside the system.

The invention of the present disclosure addresses limitations associated with the prior art.

SUMMARY OF INVENTION

The present invention contemplates a new and improved water cooler, specifically a water cooler that provides an effective system for efficiently cooling, storing and providing cooled water directly to a plumbing installation and overcomes all of the above-referenced problems and others.

In one embodiment, the water cooler includes a reservoir suitable for storing water that is being cooled and maintaining the cooler temperature of the cooled water contained therein. The reservoir has an inlet and an outlet. The reservoir is separated into top and bottom compartments by a wall having at least one opening allowing fluid communication between the compartments. A cooling element extends from the bottom surface of the reservoir through the bottom compartment, through the wall and into the top compartment. Water from a water supply enters the top compartment through an inlet, flows into the bottom compartment through one or more openings in the wall and exits from the bottom compartment through an outlet. This allows water entering the reservoir to undergo preliminary cooling in the top compartment before flowing into the bottom compartment.

In another embodiment of the invention, a conduit means is situated within a cooled air ductway. The conduit is connected at one end to the water supply line and is connected at the other end to the inlet allowing the water passing through the conduit to be cooled by cold air in the ductway before entering the reservoir.

In yet another embodiment of the invention, the reservoir is separated into three or more compartments by two or more walls each having at least one opening allowing fluid communication between the compartments.

BRIEF DESCRIPTION OF DRAWINGS

The invention may take physical from in certain parts and arrangements of parts, a preferred embodiment of which will be described in detail in this specification. Other objects and advantages of the invention will become apparent upon reading the following detailed description and upon reference to the accompanying drawing, in which.

Figure 1:
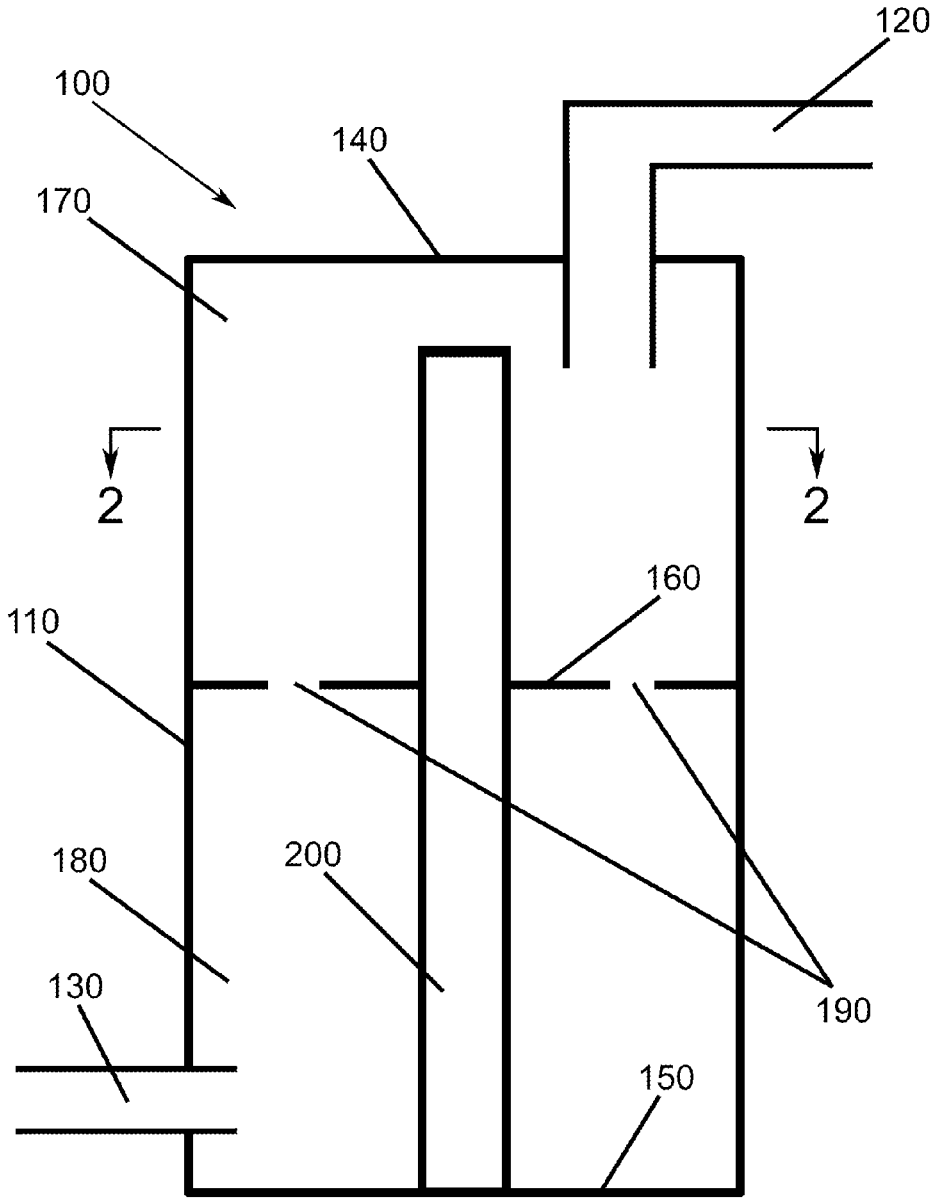
FIG. 1 is a block diagram of a water cooler constructed in accordance with the invention.

While the invention is susceptible to various modifications and alternative forms, specific embodiments thereof have been shown by way of example in the drawings are herein described in detail. It should be understood, however, that the description herein to specific embodiments is not intended to limit the invention to the particular forms disclosed, but on the contrary, the intention is to cover all modifications, equivalents, and alternatives falling within the spirit and scope of the invention.

DETAILED DESCRIPTION OF INVENTION

Illustrative embodiments of the inventions are described below. In the interest of clarity, not all features of an actual implementation are described in this specification. It will of course be appreciated that in the development of any such actual embodiment, numerous decisions specific to any particular implementation must be made to achieve the developers' goals, such as compliance with system-related and business-related constraints, which will vary from one implementation to another. Moreover, it will be appreciated that such development effort might be complex and time-consuming, but would nevertheless be a routine undertaking for those of ordinary skill in the art having the benefit of this disclosure.

FIG. 1 is a block diagram of an embodiment of a water cooler 100. The water cooler 100 includes a reservoir 110 with an inlet 120 and an outlet 130. The inlet 120 is typically connected to a water source. The outlet 130 is typically connected to the water supply line of a plumbing installation. The reservoir 110 has a top surface 140 and a bottom surface 150. A wall 160 is situated within the reservoir 110 between the top surface 140 and the bottom surface 150. The wall separates the reservoir 110 into a top compartment 170 and a bottom compartment 180. The wall 160 includes at least one opening 190 allowing water to flow between the top compartment 170 and the bottom compartment 180.

A cooling element 200 extends into the reservoir 110 from the bottom surface 150. The cooling element 200 extends through the bottom compartment 180, continues through the wall 160, and extends into the top compartment 170.

The reservoir 110 is of a material and design suited to storing water that is being cooled and to maintaining water stored therein at cooled temperatures. The reservoir 110 may be insulated to improve its energy-efficiency.

Water flowing into the reservoir 110 from the inlet 120 enters the top compartment 170 where it is separated by the wall 160 from the cooled water in the bottom compartment 180. The wall 160 prevents the direct mixing of the warm water entering through the inlet 120 with the cooled water in the bottom compartment 180.

Water entering the top compartment 170 is initially cooled by the water already present in the top compartment 170 and by the cooling element. Water already present in the top compartment has been partially cooled by the portion of the cooling element 200 present in the top compartment 170. Water entering the top compartment 170 is cooled by thermally mixing with the cooled water that is already present in the top compartment 170. In additional to the cooling effect of the thermal mixing of warm water and partially cooled water, all water in the top compartment continues to be cooled by the cooling element 200.

As water cools, it flows into the bottom compartment 180 through an opening 190 in the wall 160. Water in the bottom compartment 180 continues to be cooled by the cooling element 200 until it is drawn out of the reservoir 110 through outlet 130.

The water in the bottom compartment is not exposed directly to warm water entering the reservoir 110 thereby avoiding thermal mixing that would cause the temperature of water in the bottom compartment 180 to rise. The coolest water in the reservoir 110 will be located in the bottom compartment 180. The coolest water in the reservoir 110 flows out of the bottom compartment 180 when it is drawn through the outlet 130.

Water is drawn into the reservoir 110 through the inlet 120 as it is dispensed through the outlet 130 as required by the plumbing system to which it may be connected.

Figure 2:
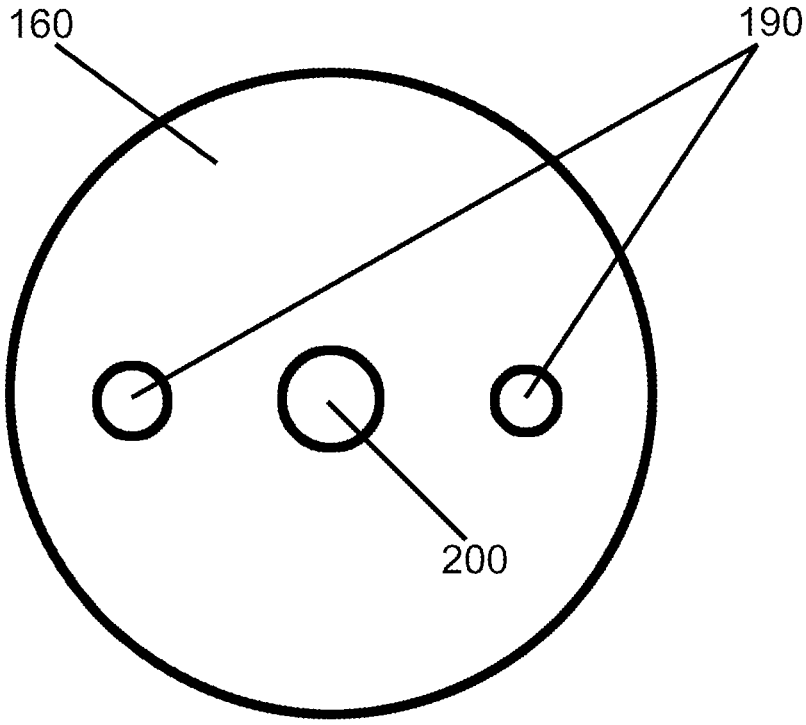
FIG. 2 is a sectional view of the water cooler along line 2-2 of FIG. 1.

FIG. 2 is a sectional view of the water cooler along line 2-2 of FIG. 1. Cooling element 200 extends from the wall 160. Water surrounds cooling element 200 on all sides and is able to flow around the cooling element unobstructed. Water is continuously cooled by cooling element 200. As water cools, it will naturally flow through opening 190 in the wall 160.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention.

While a preferred form and various embodiments of the invention has been shown in the drawings and described, since variations in the preferred form will be apparent to those skilled in the art, the invention should not be construed as limited to the specific form shown and described, but instead as set forth in the following claims.

What is claimed is:

1. A water cooler, comprising:

a reservoir having:

a top surface and a bottom surface; and a top compartment and a bottom compartment separated by a wall located between the top surface and the bottom surface, wherein the wall has at least one opening for allowing water to flow between top compartment and the bottom compartment;

at least one inlet for facilitating water to flow into the reservoir via the top surface;

at least one outlet for facilitating water to flow out of the reservoir; and a cooling element extending from the bottom surface of the reservoir into the top compartment of the reservoir through the wall for cooling water contained in the reservoir.

2. The water cooler of claim 1, wherein the reservoir is for storing water being cooled and for maintaining the water at cooled temperatures.

3. The water cooler of claim 1, wherein the inlet is in communication with the top compartment and the outlet is in communication with the bottom compartment of the reservoir.

4. The water cooler of claim 1, wherein the cooling element extends into the top compartment of the reservoir through the wall.

5. The water cooler of claim 1, wherein the outlet is connected to a water supply line.

6. A method of providing cooled water, comprising:

providing a reservoir having a top surface and a bottom surface and at least two compartments separated by at least one wall, each wall having at least one opening for allowing water to flow between the compartments;

providing a cooling element through the wall for cooling water in the at least two compartments;

receiving water for cooling into at least one of the compartments via at least one inlet in the top surface;

cooling the received water by the cooling element; and releasing the cooled water via at least one outlet.

7. The method of claim 6, wherein the compartments include a top compartment and a bottom compartment, and further comprising:

receiving water to be cooled through an inlet into a top compartment, and releasing cooled water from a bottom compartment through an outlet.

8. The water cooler of claim 1, wherein the top surface is parallel to the bottom surface.

9. The water cooler of claim 8, wherein the wall is parallel to the top and bottom surfaces.

10. The water cooler of claim 1, wherein the inlet is connected to a water source.

* * * * *